US011219839B2

(12) United States Patent
Fernandez

(10) Patent No.: US 11,219,839 B2
(45) Date of Patent: Jan. 11, 2022

(54) BUTTON ACTIVATED TRANSFORMABLE ROTATING TOY

(71) Applicant: Darwin William Fernandez, Granada (MX)

(72) Inventor: Darwin William Fernandez, Granada (MX)

( * ) Notice: Subject to any disclaimer, the term of this patent is extended or adjusted under 35 U.S.C. 154(b) by 0 days.

(21) Appl. No.: 15/877,157

(22) Filed: Jan. 22, 2018

(65) Prior Publication Data

US 2019/0168127 A1 Jun. 6, 2019

(51) Int. Cl.
*A63H 33/00* (2006.01)
*A63B 43/00* (2006.01)

(52) U.S. Cl.
CPC ..... *A63H 33/003* (2013.01); *A63B 43/00* (2013.01)

(58) Field of Classification Search
CPC ..... A63H 33/003; A63H 11/00; A63H 11/14; A63H 29/00; A63H 29/18; A63B 43/02
USPC ..... 446/72, 233, 234, 239, 260, 264, 266, 446/269, 289, 320
See application file for complete search history.

(56) References Cited

U.S. PATENT DOCUMENTS 968,057 A * 8/1910 Iwata ..... A63H 37/00 446/310
1,207,200 A * 12/1916 Novak ..... A63H 1/04 446/263
1,585,887 A * 5/1926 Beach ..... A63H 13/16 446/310
1,657,175 A * 1/1928 Peace ..... A63H 7/02 446/289
2,968,121 A * 1/1961 Pearson, Jr. ..... A63H 37/00 403/166
3,108,395 A * 10/1963 Goldfarb ..... A63H 37/00 446/311
3,798,835 A * 3/1974 McKeehan ..... A63H 33/005 446/442
4,205,482 A 6/1980 Christiansen et al.
(Continued)

FOREIGN PATENT DOCUMENTS

CN 206793044 U 12/2017
EP 2116289 A1 11/2009

OTHER PUBLICATIONS

International Search Report and Written Opinion (PCT/US2018/053900) [SR/KR] dated Feb. 1, 2019.
(Continued)

*Primary Examiner* — Joseph B Baldori
(74) *Attorney, Agent, or Firm* — Edwin S. Flores; Daniel J. Chalker; Chalker Flores, LLP

(57) ABSTRACT

The present invention includes a toy with a retractable mechanism capable of transforming its original compact shape into a new entity, comprising: a hollow sphere (1) provided with a cut on the lower part thereof (2), on the upper end a convex protuberance is projected (3), provided with a modified asymmetric cylinder, which reduces its size in the upper end assimilating the neck of the body of the sphere (4), is formed by two hinges (9A, 9B) of plastic material adjoined to cap (5) that includes one or more internal springs within the cap (5) that maintain these hinges (9A, 9B) under tension, wherein when the convex protuberance (3) is pressed it ejects the body (4) and rotates, when the sphere (1) receives a strike or is pressed, an identity different from the initial one is shown.

7 Claims, 7 Drawing Sheets

(56) References Cited

U.S. PATENT DOCUMENTS 4,519,786 A 5/1985 Larws
4,687,459 A 8/1987 Lockett
4,698,043 A * 10/1987 May ..... A63H 33/005 446/273
4,736,943 A 4/1988 Fukuda et al.
4,817,936 A 4/1989 Matsuda
5,098,327 A 3/1992 Ferrero
5,162,013 A * 11/1992 von Mohr ..... A63H 3/12 446/183
5,297,981 A * 3/1994 Maxim ..... A63H 33/005 446/437
5,409,414 A 4/1995 Sheang
5,525,090 A 6/1996 Halford et al.
5,871,386 A * 2/1999 Bart ..... A63H 15/06 446/443
5,893,789 A * 4/1999 Wu ..... A63H 33/26 40/426
5,924,909 A * 7/1999 Yamakawa ..... A63H 33/005 446/442
5,924,910 A 7/1999 Liu
6,231,346 B1 5/2001 Sagi-Dolev
6,468,126 B1 * 10/2002 Herber ..... A63H 13/16 446/308
6,536,145 B2 3/2003 Burtch et al.
6,761,612 B1 * 7/2004 Pencil ..... A63H 13/16 40/411
7,166,047 B2 1/2007 May et al.
7,306,504 B2 12/2007 Saucier
7,458,874 B2 12/2008 Rung
7,553,209 B1 6/2009 Sorensen
8,066,542 B2 * 11/2011 Ejima ..... A63H 33/003 446/376
8,500,508 B2 8/2013 Yamada et al.
8,517,791 B2 * 8/2013 Yamada ..... A63H 33/26 446/129
8,974,264 B2 3/2015 McCafferty et al.
9,308,461 B2 4/2016 Yamada et al.
9,694,295 B2 7/2017 Walterscheid
9,975,058 B2 5/2018 Yamada et al.
2014/0094082 A1 4/2014 Swartz et al.
2015/0238880 A1 * 8/2015 Austin ..... A63H 33/003 446/376
2016/0214025 A1 7/2016 Yamada et al.
2016/0361661 A1 * 12/2016 Tiefel ..... A63H 33/003

OTHER PUBLICATIONS

International Search Report and Written Opinion (PCT/US2018/053906) [SR/KR] dated Feb. 1, 2019.

* cited by examiner

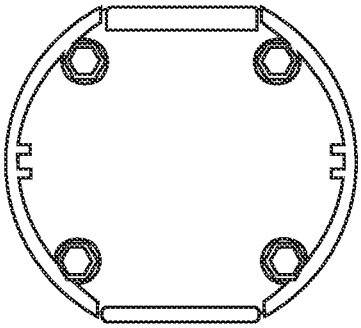
FIG 2B
FIG 3
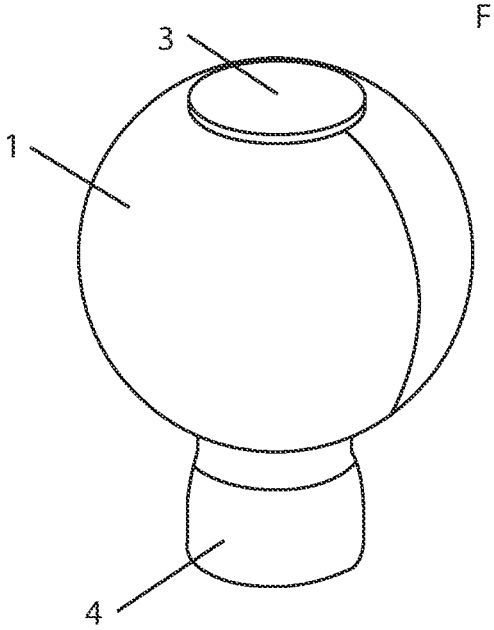

BUTTON ACTIVATED TRANSFORMABLE ROTATING TOY

CROSS-REFERENCE TO RELATED APPLICATIONS

This application is a continuation-in-part of, and claims priority to, Mexican Patent Application No. MX/f/2017/003251, filed Oct. 20, 2017, the entire contents of which are incorporated herein by reference.

STATEMENT OF FEDERALLY FUNDED RESEARCH

None.

TECHNICAL FIELD OF THE INVENTION

The present invention relates in general to the field of toys.

BACKGROUND OF THE INVENTION

Without limiting the scope of the invention, its background is described in connection with rotating toys.

One such toy is taught in U.S. Pat. Nos. 9,308,461 and 8,500,508, issued to Yamada, et al., entitled "Transformable toy", teach a toy with an exterior structure that is constructed to transform from a rollable first shape to a second shape. An interior structure inside the exterior structure is endowed with a magnetic body that moves by way of a magnetic force that acts from the exterior of the toy, an interior locking portion that moves simultaneously with the movement of this magnetic body, and a biasing member that effects a force which moves or turns this interior locking portion in a particular direction. According to this invention, if the magnetic force does not act from the exterior of the toy, the first shape of the exterior structure maintained. In the event that a magnetic force has acted from the exterior of the said toy, the exterior structure transforms from the first shape to the second shape.

Another such toy is taught in U.S. Pat. No. 7,166,047, issued to May, et al., entitled, "Toy ball", which teaches a toy ball that is formed from two shells and a pair of lock mechanisms. During construction, the shells, which may be hemispherical, are mated together and then the lock mechanisms are secured to the shells to form a substantially smooth-surfaced sphere, wherein the lock mechanisms provide a redundant locking feature to hold the two shells together to form the toy ball.

Finally, U.S. Pat. No. 5,409,414, issued to Sheang, and entitled "Toy sphere" teaches a toy sphere that includes an annular member provided with a circular groove at both sides, a plurality of internal gear teeth at an inner surface, and two opposite eccentric pins at an outer surface, a power seat threadedly engaged with the internal gear teeth of the annular member and having a motor electrically connected with batteries, an upper hemispherical housing having internal threads, a lower hemispherical housing having external threads engageable with the internal threads of the upper hemispherical and having two aligned holes engaged with the two opposite eccentric pins of the annular member.

SUMMARY OF THE INVENTION

The present invention is a sphere-shaped toy; with a retractable mechanism, that upon pressing the upper button ejects a cylindrical figure capable of transforming its original compact shape into a new entity, without the need to manipulate or add new parts to which corresponds a toy with characteristics described hereafter pursuant to the drawings that form an integral part of this submission.

In one embodiment, the present invention includes a sphere-shaped toy that rotates on its own axis, when held from an edges or a body with a retractable mechanism capable of transforming its original compact shape into a new entity, without the need to manipulate its parts or add new parts comprising: a hollow sphere (1), provided with an opening (2) on a lower end of the hollow sphere (1), and at a higher end of the hollow sphere (1) a convex protuberance (3) that has a surface at or projected above the hollow sphere (1); and a body (4) provided as a modified asymmetrical cylinder, which reduces its size at a higher end of the body (4) and assimilating a neck of the body (4), wherein the hollow sphere (1) is formed by two hinges (9A, 9B) of plastic material adjoined to cap (5) that includes one or more internal springs within the cap (5) that maintain these hinges (9A, 9B) under tension, wherein when the convex protuberance (3) is pressed ejects the body (4), and is capable of transforming its original compact shape into a new entity, without the need to manipulate parts or add new parts to this toy, in such a way that if the sphere is held by the edges it activates the operation and starts to rotate on its own axis, in such a way that, when the sphere (1) receives a strike, the internal body of the sphere (1) moves the body with the impact (4); changing between sphere (1) and the body (4) an identity different from an initial shape. In one aspect, as soon as the body (4) is outside of the sphere (1), it is constituted in the head of the body. In another aspect, the body (4) is composed of a single part, which provides it with higher rigidity and resistance. In another aspect, the shape of the body (4) can display several aspects depending on the targeted segment, from the type of color, pattern, among others and whether animal or human, the latter with either male, female or asexual gender, or with the appearance of a baby, a child or an adult. In another aspect, the sphere (1) can allow for different variations, ranging from an oval shape, different colors or textures, or different faces, depending on the adhesive adjoined to the frontal, lateral and rear surfaces. In another aspect, the apparatus further comprises indicia on an exterior surface of the sphere (1) of one or more characters, shapes, graphics, or lines.

In another embodiment, the present invention includes a method of making a sphere-shaped toy that rotates on its own axis, when held from an edges or a body with a retractable mechanism capable of transforming its original compact shape into a new entity, without the need to manipulate its parts or add new parts comprising: providing a hollow sphere (1), provided with an opening (2) on a lower end of the hollow sphere (1), and at a higher end of the hollow sphere (1) a convex protuberance (3) that has a surface at or projected above the hollow sphere (1); and inserting a body (4) that is provided as a modified asymmetrical cylinder, which reduces its size at a higher end of the body (4) and assimilating a neck of the body (4), wherein the hollow sphere (1) is formed by two hinges (9A, 9B) of plastic material adjoined to cap (5) that includes one or more internal springs within the cap (5) that maintain these hinges (9A, 9B) under tension, wherein when the convex protuberance (3) is pressed ejects the body (4), and is capable of transforming its original compact shape into a new entity, without the need to manipulate parts or add new parts to this toy, in such a way that if the sphere is held by the edges it activates the operation and starts to rotate on its own axis, in such a way that, when the sphere (1) receives a strike, the internal body of the sphere (1) moves the body with the impact (4); changing between sphere (1) and the body (4) an identity different from an initial shape. In another aspect, the body (4) is out of the sphere (1), it is constituted at the head of the body. In another aspect, the body (4) is constituted by one single part, which provides it with a higher rigidity and resistance. In another aspect, the shape of the body (4) can display several aspects, depending on the targeted segment, from the type of color, pattern, among others, whether it is animal or human, the latter with either male, female, or asexual gender, or with the appearance of a baby, a child or an adult. In another aspect, the sphere (1) can allow for different variations, ranging from an oval shape, different colors or textures, or different faces, depending on the adhesive adjoined to the frontal, lateral and rear surfaces.

In another embodiment, the present invention includes a toy with a retractable mechanism capable of transforming its original compact shape into a new entity, without the need to manipulate its parts or add new parts, consisting essentially of: a hollow sphere (1), provided with an opening (2) on a lower end of the hollow sphere (1), and at a higher end of the hollow sphere (1) a convex protuberance (3) that has a surface at or projected above the hollow sphere (1); a body (4) provided as a modified asymmetrical cylinder, which reduces its size at a higher end of the body (4) and assimilating a neck of the body (4), wherein the hollow sphere (1) is formed by two hinges (9A, 9B) of plastic material adjoined to cap (5) that includes one or more internal springs within the cap (5) that maintain these hinges (9A, 9B) under tension, wherein when the convex protuberance (3) is pressed ejects the body (4), and is capable of transforming its original compact shape into a new entity, without the need to manipulate parts or add new parts to this toy, in such a way that if the sphere is held by the edges it activates the operation and starts to rotate on its own axis, in such a way that, when the sphere (1) receives a strike, the internal body of the sphere (1) moves the body with the impact (4); changing between sphere (1) and the body (4) an identity different from an initial shape.

In another embodiment, the present invention includes a toy with a retractable mechanism capable of transforming its original compact shape into a new entity, without the need to manipulate its parts or add new parts, consisting of: a hollow sphere (1), provided with an opening (2) on a lower end of the hollow sphere (1), and at a higher end of the hollow sphere (1) a convex protuberance (3) that has a surface at or projected above the hollow sphere (1); and a body (4) provided as a modified asymmetrical cylinder, which reduces its size at a higher end of the body (4) and assimilating a neck of the body (4), wherein the hollow sphere (1) is formed by two hinges (9A, 9B) of plastic material adjoined to cap (5) that includes one or more internal springs within the cap (5) that maintain these hinges (9A, 9B) under tension, wherein when the convex protuberance (3) is pressed ejects the body (4), and is capable of transforming its original compact shape into a new entity, without the need to manipulate parts or add new parts to this toy, in such a way that if the sphere is held by the edges it activates the operation and starts to rotate on its own axis, in such a way that, when the sphere (1) receives a strike, the internal body of the sphere (1) moves the body with the impact (4); changing between sphere (1) and the body (4) an identity different from an initial shape.

BRIEF DESCRIPTION OF THE DRAWINGS

For a more complete understanding of the features and advantages of the present invention, reference is now made to the detailed description of the invention along with the accompanying figures and in which:

FIGS. 2A and 2B shows a cross-section view of the rotating toy in an extended position, showing the internal mechanism that moves the inner body and an opposite hemisphere of the toy.

FIG. 3 shows a perspective view of the rotating toy in an extended position.

DETAILED DESCRIPTION OF THE INVENTION

Figure 1:
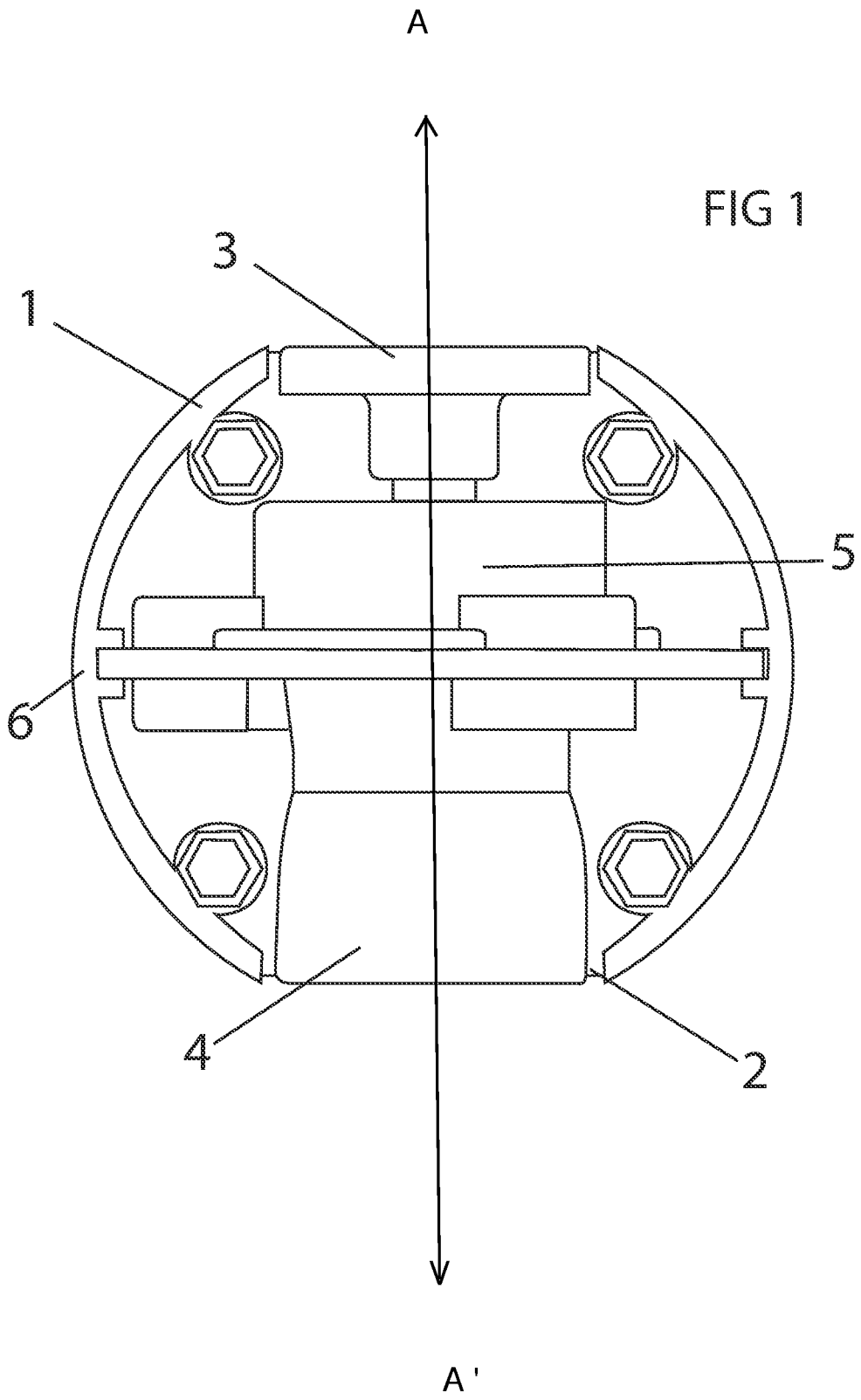
FIG. 1 shows a cross-section view of a rotating toy in a compact position of this industrial design.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not limit the invention, except as outlined in the claims.

The invention for which registration is sought is composed a hollow sphere (1), with a cut or opening (2) on the lower part thereof, which when pressing the button (3) on the upper end of the hollow sphere (1), and without losing its original design, ejects a retractable body (4) that allows for the hollow sphere (1) to remain in a standing position and has an inner mechanism (5) that allows for the sphere to rotate on its axis (A-A'), the same button that ejects the sphere allows to take it and to continue rotating (3) which upon being pressed, activates the operation of the device (6) causing the ejection of the body (4) from the hollow sphere (1), provided with a modified asymmetrical cylinder that reduces its size in the upper end assimilating the neck of the body (4) of the hollow sphere (1), allows to hold it whether it is inside or outside of the hollow sphere (1) and allows it to continue rotating (4), when pressing the top button (3) in such a way that as soon as the body is outside, the sphere (1) is constituted in the head of the body (4), and together the hollow sphere (1) and the body (4) constitute an identity different than an initial identity.

Additionally, the body (4) shows the important characteristic of being formed from one single part providing it with a higher rigidity and resistance. The shape of the cylindrical body (4) will always be the same, without limitation to variations depending on the targeted segment, ranging from the type of color, pattern, among others whether animal or human, and the latter with either male, female or asexual gender, or with the appearance of a baby, a child or an adult. The sphere (1) can also allow for different variations, ranging from an oval shape, different colors or textures, or different faces, depending on the adhesive adjoined to the frontal, lateral and rear surfaces.

Another main characteristic is that the sphere can be held from the edges and rotated so that it obtains speed and rotates for one or two minutes, it can also rotate by holding it from its base or body without affecting its rotation.

Figure 2A:
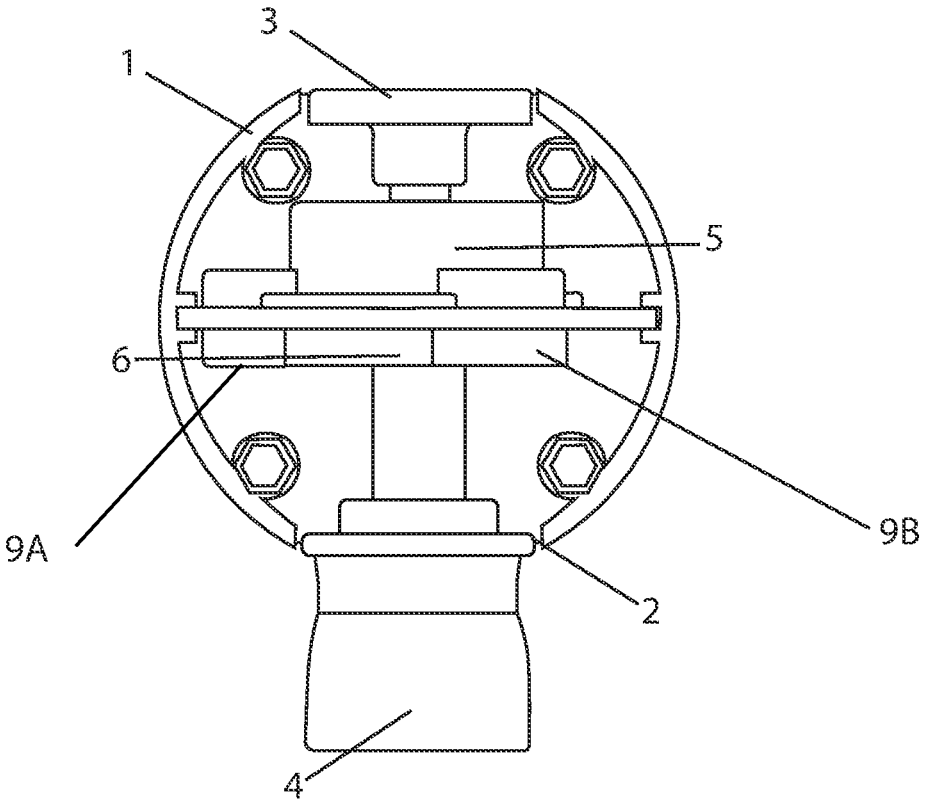

FIGS. 2A and 2B show a cross sectional view of one side of the hollow sphere (1) showing the body (4) in an extended position, as well as the rotating mechanism (5) in an extended position. The body (4) traverses the opening or cut (2) in the hollow sphere (1), and the position for the screws (not shown) that hold the two hemispheres (FIG. 2A being one hemisphere and FIG. 2B the other), of the hollow sphere (1) together are also shown.

FIG. 3 shows a perspective view of the rotating toy in an extended position. FIG. 3 shows the relative position of the top button (3) with respect to the hollow sphere (1) and the body (4) shown in this example in an extended position.

Figure 4:
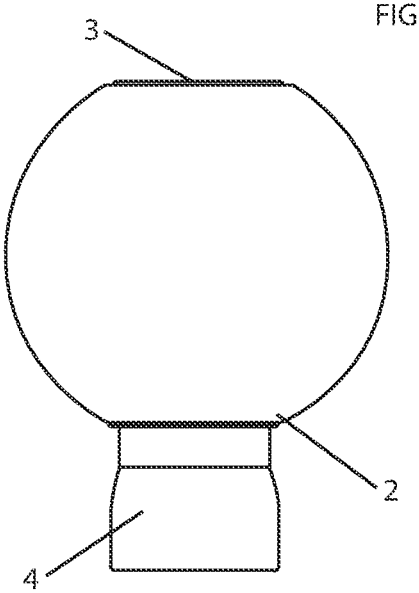
FIG. 4 shows a frontal elevation view of the rotating toy in an extended position.

FIG. 4 shows a frontal elevation view of the rotating toy in an extended position. FIG. 4 shows the relative position of the top button (3) with respect to the hollow sphere (1) and the body (4) shown in this example in an extended position through opening or cut (2).

Figure 5:
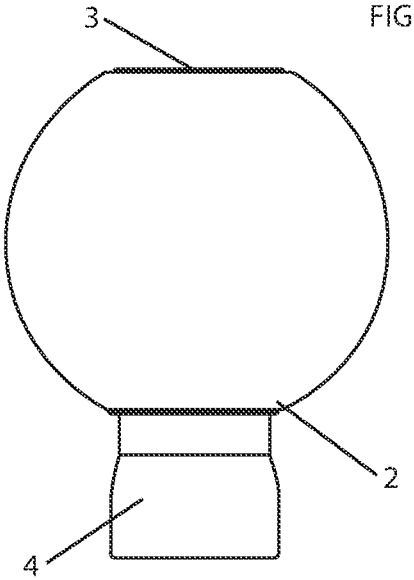
FIG. 5 shows a right profile view of the rotating toy in an extended position.

FIG. 5 shows a right profile view of the rotating toy in an extended position. FIG. 5 shows the relative position of the top button (3) with respect to the two halves of the hollow sphere (1) and the body (4) shown in this example in an extended position through opening or cut (2).

Figure 6:
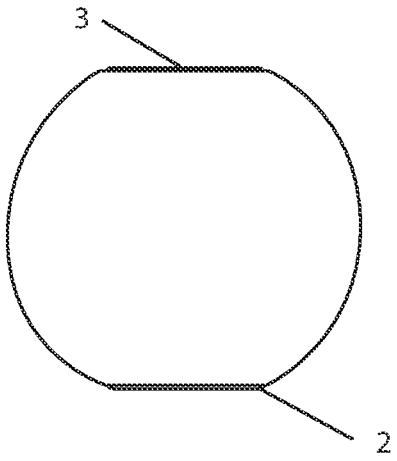
FIG. 6 shows a right profile view of the rotating toy in a compact position.

FIG. 6 shows a right profile view of the rotating toy in a compact position. FIG. 6 shows the relative position of the top button (3) with respect to the two halves of the hollow sphere (1) and the body (4) shown in this example in a compact or non-extended position in relation to the opening or cut (2).

Figure 7:
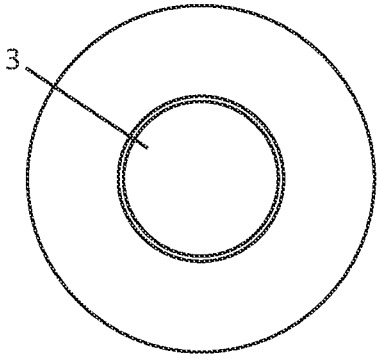
FIG. 7 shows an upper level view of the rotating toy in an extended position.

FIG. 7 shows an upper level view of the rotating toy in an extended position. FIG. 7 shows the relative position of the top button (3) with respect to the two halves of the hollow sphere (1).

Figure 8:
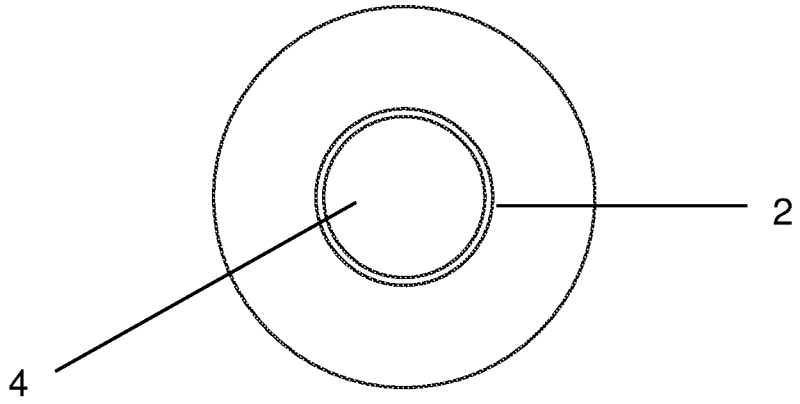
FIG. 8 shows a lower level view of the rotating toy in an extended position.

FIG. 8 shows a lower level view of the rotating toy in an extended position. FIG. 8 shows the relative position of the body (4) with respect to the two halves of the hollow sphere (1) and the body (4) shown in this example in a compact or non-extended position in relation to the opening or cut (2).

Figure 9:
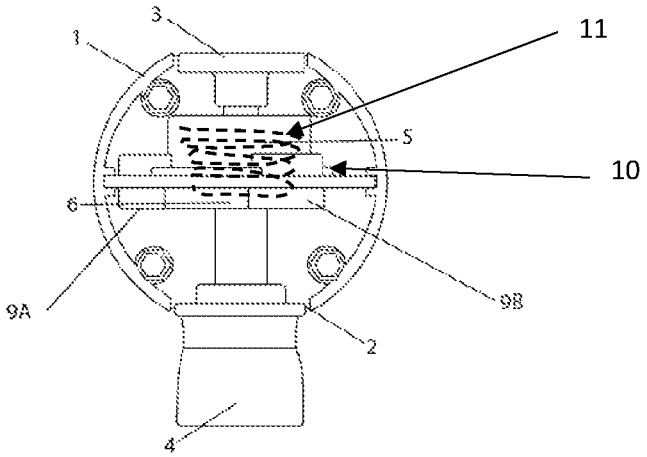
FIG. 9 a cross-section view of the rotating toy in an extended position, showing the internal mechanism that moves the inner body and an opposite hemisphere of the toy.

FIG. 9 shows a toy with a retractable mechanism capable of transforming its original compact shape into a new entity, without the need to manipulate its parts or add new parts, consisting of: a hollow sphere (1), provided with an opening (2) on a lower end of the hollow sphere (1), and at a higher end of the hollow sphere (1) a convex protuberance (3) that has a surface at or projected above the hollow sphere (1); and a body (4) provided as a modified asymmetrical cylinder, which reduces its size at a higher end of the body (4) and assimilating a neck of the body (4), wherein the hollow sphere (1) has two hinges (9A, 9B) of plastic material adjoined to cap (5) that includes one or more internal springs (11) within the cap (5) and a projection (10) that maintains these hinges (9A, 9B) under tension, wherein when the convex protuberance (3) is pressed it ejects the body (4), and is capable of transforming its original compact shape into a new entity, without the need to manipulate parts or add new parts to this toy, in such a way that if the hollow sphere (1) is held by the edges it activates the operation and starts to rotate on its own axis, in such a way that, when the sphere (1) receives a strike, the internal body (4) moves the body with the impact at the convex protuberance (3); changing between sphere (1) and the body (4) an identity different from an initial shape.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps. In embodiments of any of the compositions and methods provided herein, "comprising" may be replaced with "consisting essentially of" or "consisting of". As used herein, the phrase "consisting essentially of" requires the specified integer(s) or steps as well as those that do not materially affect the character or function of the claimed invention. As used herein, the term "consisting" is used to indicate the presence of the recited integer (e.g., a feature, an element, a characteristic, a property, a method/process step or a limitation) or group of integers (e.g., feature(s), element(s), characteristic(s), property(ies), method/process steps or limitation(s)) only.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skill in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

To aid the Patent Office, and any readers of any patent issued on this application in interpreting the claims appended hereto, applicants wish to note that they do not intend any of the appended claims to invoke paragraph 6 of 35 U.S.C. § 112, U.S.C. § 112 paragraph (f), or equivalent, as it exists on the date of filing hereof unless the words "means for" or "step for" are explicitly used in the particular claim.

For each of the claims, each dependent claim can depend both from the independent claim and from each of the prior dependent claims for each and every claim so long as the prior claim provides a proper antecedent basis for a claim term or element.

What is claimed is:

1. A sphere-shaped toy comprising:

a hollow sphere with a lower end with a lower opening, an upper end with an upper opening, and a longitudinal axis that extends between the lower end and the upper end;

a protuberance at the upper opening of the hollow sphere, wherein a surface of the protuberance is at or above the hollow sphere;

a body that is longitudinally aligned with a longitudinal axis of the body at a first position in the hollow sphere and attached to a release and spinning mechanism in the hollow sphere, wherein the body rotates when released from the first position; and one or more hinges that connect the protuberance to the release and spinning mechanism, wherein striking the protuberance both releases and spins the hollow sphere along the longitudinal axis in relation to the body and releases the body to a second position outside the lower end of the hollow sphere, wherein ejection of the body from a bottom of the body transforms the toy into a new entity, and wherein the body can be pushed back into the hollow sphere at the first position, wherein when the body is in the second position, the hollow sphere becomes a head of the body.

2. The apparatus of claim 1, wherein the body is composed of a single part.

3. The apparatus of claim 1, wherein the body has a color or pattern, a shape of an animal or human, male, female or asexual gender, a baby, a child or an adult.

4. The apparatus of claim 1, wherein an exterior surface of the sphere has colors, textures, or one or more faces.

5. The apparatus of claim 1, further comprising indicia on an exterior surface of the sphere (1) of one or more characters, shapes, graphics, or lines.

6. A toy consisting essentially of:

a hollow sphere with a lower end with a lower opening, an upper end with an upper opening, and a longitudinal axis that extends between the lower end and the upper end;

a protuberance at the upper opening of the hollow sphere, wherein a surface of the protuberance is at or above the hollow sphere;

a body that is longitudinally aligned with a longitudinal axis of the body at a first position in the hollow sphere and attached to a release and spinning mechanism in the hollow sphere, wherein the body rotates when released from the first position; and one or more hinges that connect the protuberance to the release and spinning mechanism, wherein striking the protuberance both releases and spins the hollow sphere along the longitudinal axis in relation to the body and releases the body from a bottom of the body to a second position at the lower end of the outside the hollow sphere, wherein ejection of the body transforms the toy into a new entity, and wherein the body can be pushed back into the hollow sphere at the first position, wherein when the body is in the second position, the hollow sphere becomes a head of the body.

7. A toy consisting of:

a hollow sphere with a lower end with a lower opening, an upper end with an upper opening, and a longitudinal axis that extends between the lower end and the upper end;

a protuberance at the upper opening of the hollow sphere, wherein a surface of the protuberance is at or above the hollow sphere;

a body that is longitudinally aligned with a longitudinal axis of the body at a first position in the hollow sphere and attached to a release and spinning mechanism in the hollow sphere, wherein the body rotates when released from the first position; and one or more hinges that connect the protuberance to the release and spinning mechanism, wherein striking the protuberance both releases and spins the hollow sphere along the longitudinal axis in relation to the body and releases the body from a bottom of the body to a second position at the lower end on the outside the hollow sphere, wherein ejection of the body transforms the toy into a new entity, and wherein the body can be pushed back into the hollow sphere at the first position, wherein when the body is in the second position, the hollow sphere becomes a head of the body.

* * * * *